US009683339B2

(12) United States Patent
Thompson et al.

(10) Patent No.: US 9,683,339 B2
(45) Date of Patent: Jun. 20, 2017

(54) PORTABLE ROADWAY WARNING DEVICE

(71) Applicant: TRINITY HIGHWAY PRODUCTS, LLC, Dallas, TX (US)

(72) Inventors: Sean Thompson, Elk Grove, CA (US); Kent Kekeis, St. John, IN (US)

(73) Assignee: Trinity Highway Products, LLC, Dallas, TX (US)

( * ) Notice: Subject to any disclaimer, the term of this patent is extended or adjusted under 35 U.S.C. 154(b) by 126 days.

(21) Appl. No.: 14/748,427

(22) Filed: Jun. 24, 2015

(65) Prior Publication Data

US 2015/0376849 A1 Dec. 31, 2015

Related U.S. Application Data

(60) Provisional application No. 62/017,017, filed on Jun. 25, 2014.

(51) Int. Cl.

| | |
|---|---|
| ***E01F 9/06*** | (2006.01) |
| ***E01F 9/604*** | (2016.01) |
| ***E01F 9/688*** | (2016.01) |
| ***E01F 9/529*** | (2016.01) |

(52) U.S. Cl.

CPC ..... *E01F 9/604* (2016.02); *E01F 9/529* (2016.02); *E01F 9/688* (2016.02)

(58) Field of Classification Search

CPC ..... E01F 9/047; E01F 9/04; E01F 9/06; E01F 9/093; E01F 15/02; E01F 15/086; E01F 15/00; E01F 13/10; E01F 11/00

USPC ..... 404/15

See application file for complete search history.

(56) References Cited

U.S. PATENT DOCUMENTS 3,334,554 A * 8/1967 Adams ..... E01F 9/042 116/35 R
3,859,000 A 1/1975 Webster
4,362,424 A 12/1982 Barber
(Continued)

FOREIGN PATENT DOCUMENTS

GB 2 030 197 A 4/1980
GB 2214209 A 8/1989
(Continued)

OTHER PUBLICATIONS

Notification of Transmittal and International Search Report in PCT Application No. PCT/US 15/37331 dated Dec. 4, 2015, 6 pages.
(Continued)

*Primary Examiner* — Abigail A Risic
(74) *Attorney, Agent, or Firm* — Brinks Gilson & Lione

(57) ABSTRACT

A portable roadway warning device includes a core having a plurality of weights embedded in a polymeric material, wherein the weights have a greater density than the polymeric material, and a housing having opposite first and second side surfaces, a leading edge, a trailing edge, and an upper vehicle interface surface. The housing covers the core. The leading and trailing edges define a distance D therebetween, wherein each of the weights has a maximum lengthwise less than ½ D. A first connector member extends outwardly from the first side surface, and a second connector member extends outwardly from the second side surface. An assembly of roadway warning devices, and methods of installing and manufacturing such devices, are also provided.

30 Claims, 14 Drawing Sheets

(56) References Cited

U.S. PATENT DOCUMENTS

| | | | | |
|---|---|---|---|---|
| 4,586,847 | A * | 5/1986 | Stanton | B02C 19/16 172/40 |
| 4,697,294 | A | 10/1987 | Schäfer | |
| 4,974,991 | A | 12/1990 | Mandavi | |
| 5,267,367 | A | 12/1993 | Wegmann, Jr. | |
| 5,448,232 | A | 9/1995 | Tyburski | |
| 5,450,077 | A * | 9/1995 | Tyburski | G08G 1/02 200/86 A |
| 5,775,834 | A | 7/1998 | Jackson | |
| 6,010,277 | A | 1/2000 | Follman | |
| 6,102,612 | A | 8/2000 | Pricone et al. | |
| 6,168,276 | B1 | 1/2001 | Weid | |
| 6,174,103 | B1 | 1/2001 | Stroman | |
| 6,309,137 | B1 | 10/2001 | Hirsch | |
| 6,457,900 | B2 | 10/2002 | Bond | |
| 6,623,206 | B1 | 9/2003 | Blair | |
| 6,659,682 | B2 | 12/2003 | Heeks | |
| 7,621,691 | B2 | 11/2009 | Hannah | |
| 7,736,087 | B1 | 6/2010 | Mettler et al. | |
| RE41,851 | E | 10/2010 | Heinz | |
| 8,453,995 | B2 | 6/2013 | Christensen et al. | |
| 2005/0072094 | A1 | 4/2005 | Ardern | |
| 2010/0158607 | A1 | 6/2010 | Mettler et al. | |
| 2010/0215431 | A1 | 8/2010 | Mettler et al. | |
| 2014/0190395 | A1 | 7/2014 | Cowan | |
| 2015/0030390 | A1 * | 1/2015 | Brown | E01F 9/047 404/15 |
| 2015/0110554 | A1 * | 4/2015 | Mettler | E01F 9/047 404/15 |

FOREIGN PATENT DOCUMENTS

| | | |
|---|---|---|
| GB | 2240801 A | 8/1991 |
| WO | WO 91/19856 | 12/1991 |

OTHER PUBLICATIONS

Written Opinion of the ISA in PCT Application No. PCT/US15/37331 dated Dec. 4, 2015, 11 pages.

Online TrafFix Devices, Inc., "TraFix Alert® Rumble Strip," product bulletin, www.traffixdevices.com, date unknown, 2 pages.

TAPCO (Traffic & Parking Control Company), "Traffic Guard Portable Speed Bump," product detail, printed 2014, 2 pages.

PSS, RoadQuake2™, "Temporary Portable Rumble Strip," product brochure, dated Aug. 2013, 2 pages.

ATSSA brochure, "Guidance for the Use of Temporary Rumble Strips in Work Zones," dated Sep. 2013, 24 pages.

* cited by examiner

FIG. 6
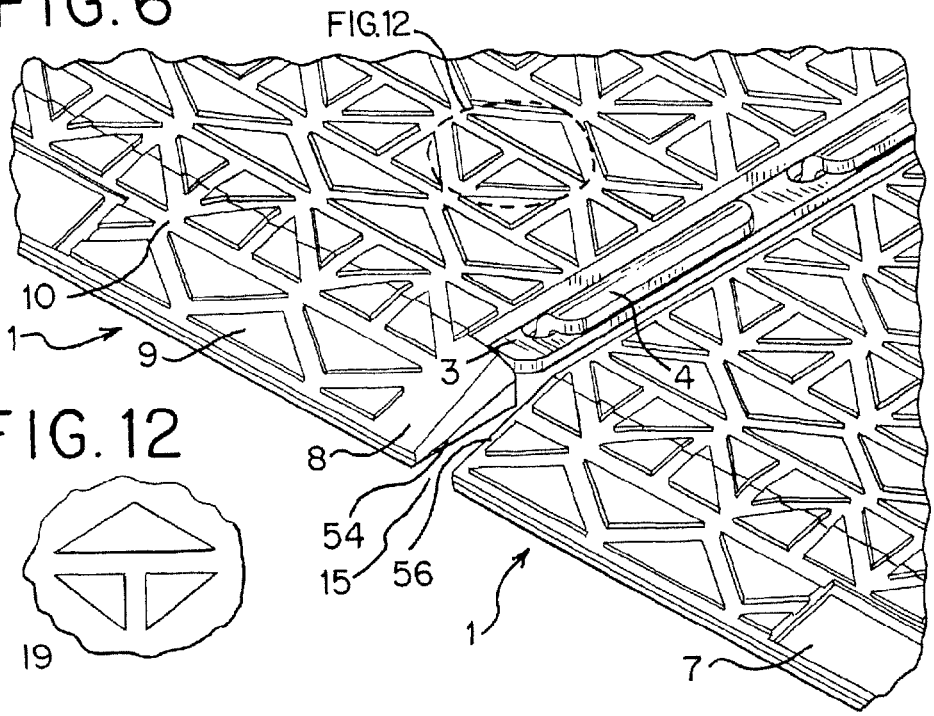
FIG. 12
FIG. 7
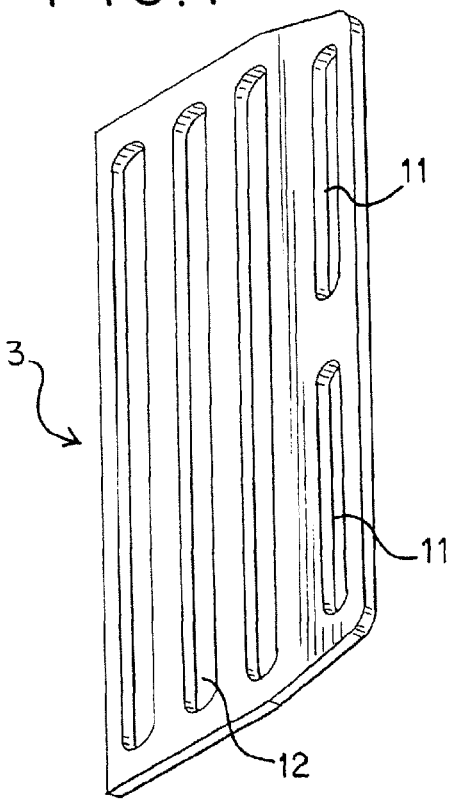
FIG. 8
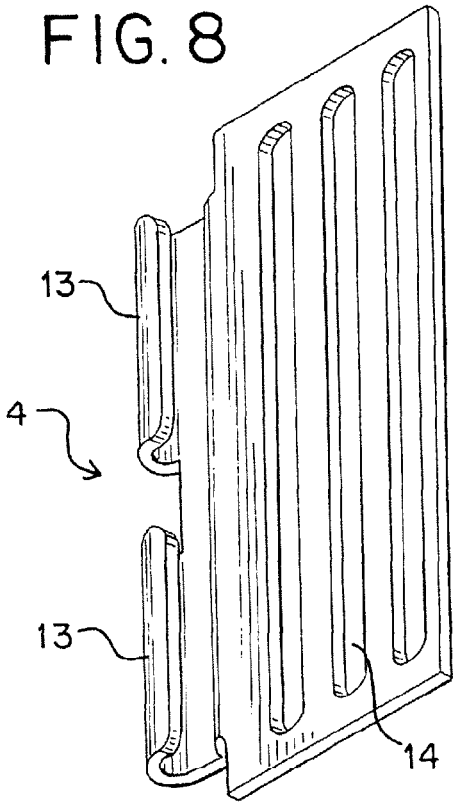

PORTABLE ROADWAY WARNING DEVICE

This application claims the benefit of U.S. Provisional Application Ser. No. 62/017,017, filed Jun. 25, 2014, the entire disclosure of which is hereby incorporated herein by reference.

TECHNICAL FIELD

The present application relates generally to a portable roadway warning device, for example and without limitation a rumble strip, and to assemblies of such devices and methods of making, using and installing such devices.

BACKGROUND

Road agencies and construction crews often deploy portable roadway warning devices, such as rumble strips, in work zones and other temporary roadway control locations. The Federal Highway Administration, U.S. Department of Transportation, has provided guidance acknowledging that portable rumble strips are effective in improving driver compliance to warning signs in flagging operations, roadway safety check-points, lane closures, routine maintenance operations, paving operations, or other situations where daily installation and removal may be required. Since work zones are temporary, it is desirable to provide portable rumble strips that may be deployed and removed quickly. However, it may also be desirable that the portable rumble strips not move out of position as vehicles pass over them at highway speeds, and are free of adhesives and/or mounting fasteners. It also is desirable that the rumble strips be reusable.

To reduce the risk of being struck by passing vehicles, it also is desirable that road workers be able to remove the warning devices from the road without entering the roadway. For example, if a plurality of warning device members is deployed across a roadway, it is desirable for the members to remain coupled such that the entire assembly may be removed by retrieving the assembly or device from the side of the road. One warning device, described in U.S. Patent Publication No. US2010/0215431A, includes interlocking notches and tabs, which may be difficult to lock together, and may not maintain a robust connection when removing the assembly or device from the side of the road.

To maintain the portable warning device in position when being run over by vehicles, especially when anchoring devices are avoided in temporary sites, it may be necessary to increase the weight per unit of area of the warning device to a higher value than a comparable thickness of rubber. For example, U.S. Pat. No. 7,736,087 discloses the use of laterally spaced bars or plates within a rubber rumble strip. Such a construction, however, does not allow the strip to match the contour of the roadway in a longitudinal or traffic-flow direction.

In addition, when a vehicle rolls over a strip, a harmonic oscillation may be propagated parallel to the rumble strip. Specifically, when the vehicle's front tires pass over the strip, the strip oscillates while the rear tires pass over the strip. Because the strip is not sitting flat on the ground at that moment, the strip may move in the direction of vehicle travel. As such, the strip may creep forward in the direction of vehicle travel over time.

SUMMARY

In one aspect, one embodiment of a portable roadway warning device includes a core having a plurality of weights embedded in a polymeric material, wherein the weights have a greater density than the polymeric material, and a housing having opposite first and second side surfaces, a leading edge, a trailing edge, and an upper vehicle interface surface. The housing covers the core. The leading and trailing edges define a distance D therebetween, wherein each of the weights has a maximum longitudinal dimension less than ½ D. A first connector member extends outwardly from the first side surface, and a second connector member extends outwardly from the second side surface.

In another aspect, a portable roadway warning assembly includes a plurality of roadway warning devices. The first connector of one of the plurality of roadway warning devices is connected to the second connector of an adjacent one of the plurality of roadway warning devices. The first and second connectors may be moved from a disengaged configuration to a locked configuration.

In yet another aspect, a method of installing a portable roadway warning assembly includes providing a plurality of roadway warning devices and connecting the first connector of one of the plurality of roadway warning devices to the second connector of an adjacent one of the plurality of roadway warning devices. In one embodiment, the first and second sides of the roadway warning devise are spaced apart.

In another aspect, a method of manufacturing a portable roadway warning device includes forming a core by embedding a plurality of weights in a polymeric material and covering the core with a housing.

In another aspect, a portable roadway warning device includes a housing having opposite first and second side surfaces, a leading edge, a trailing edge longitudinally spaced from the leading edge, and an upper vehicle interface surface. The housing includes a recess formed in the upper vehicle interface surface. An illuminating material is disposed in the recess.

The portable roadway warning device and assembly, and methods of installing, using and making such devices and assemblies, provide various significant advantages over other portable roadway warning devices. For example and without limitation, the portable roadway warning device is properly weighted, such that it does not move out of position when impacted by a vehicle at highway speeds. In addition, adjacent devices may be locked together, which facilitates their deployment and removal, and maintains the integrity of the assembly when in use. In various embodiments, the upper tread, and separately and independently the spacing between adjacent devices, allows for the passage of water and eliminates the pooling of water, especially when such devices are deployed across an incline, or example a roadway inclined (up or down) in the traffic-flow direction. The various materials and construction allow for ease of manufacture and deployment, while remaining robust and long lived in inclement environments.

The foregoing paragraphs have been provided by way of general introduction, and are not intended to limit the scope of the following claims. The presently preferred embodiments, together with further advantages, will be best understood by reference to the following detailed description taken in conjunction with the accompanying drawings.

BRIEF DESCRIPTION OF THE DRAWINGS

FIG. 6 is an enlarged view of the connection between adjacent portable roadway warning devices.

FIG. 7 is a close up isometric view of the loop connector.

FIG. 8 is a close up isometric view of the hook connector.

FIG. 12 is a representative embossment pattern taken along line 12 replicating a logo of Trinity Industries.

DETAILED DESCRIPTION OF THE PRESENTLY PREFERRED EMBODIMENTS

Figure 1:
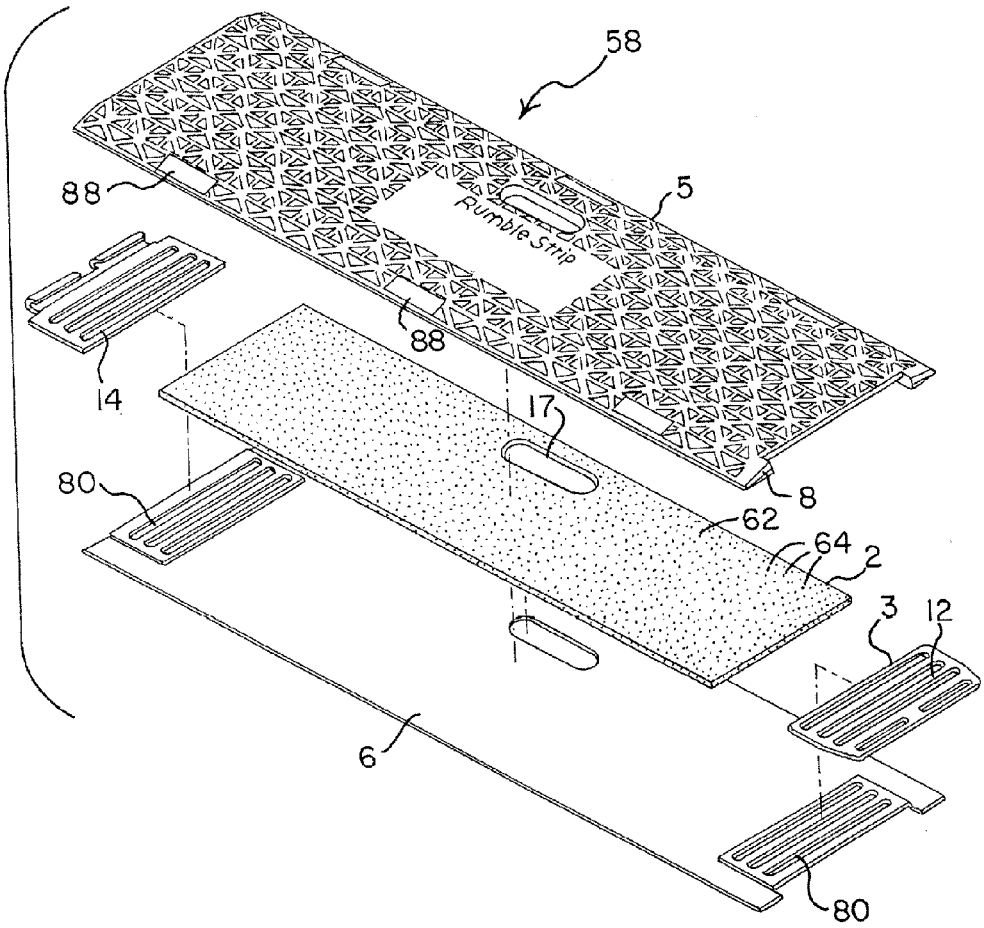
FIG. 1 is an exploded isometric view of one embodiment of a portable roadway warning device.
Figure 2:
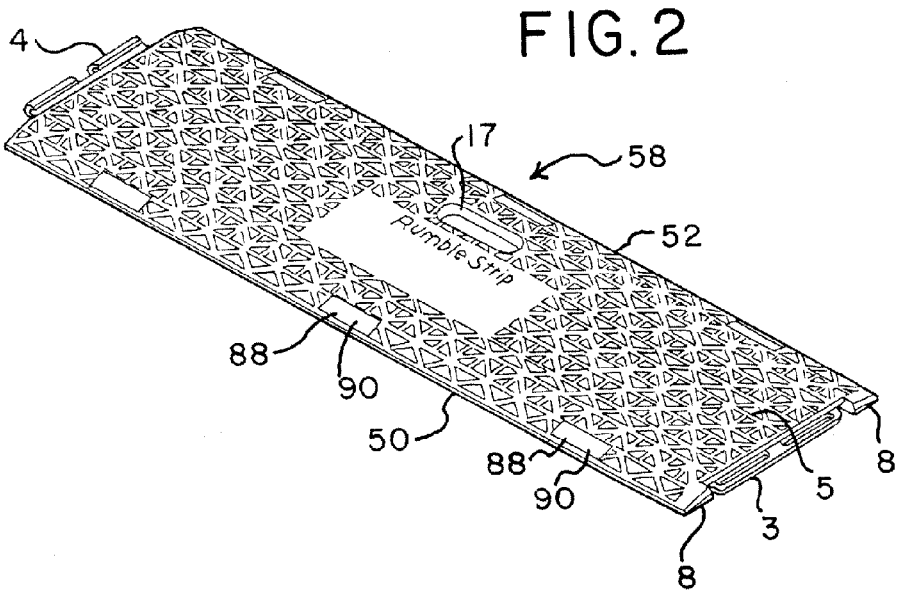
FIG. 2 is an isometric view of the top of the portable roadway warning device.
Figure 3:
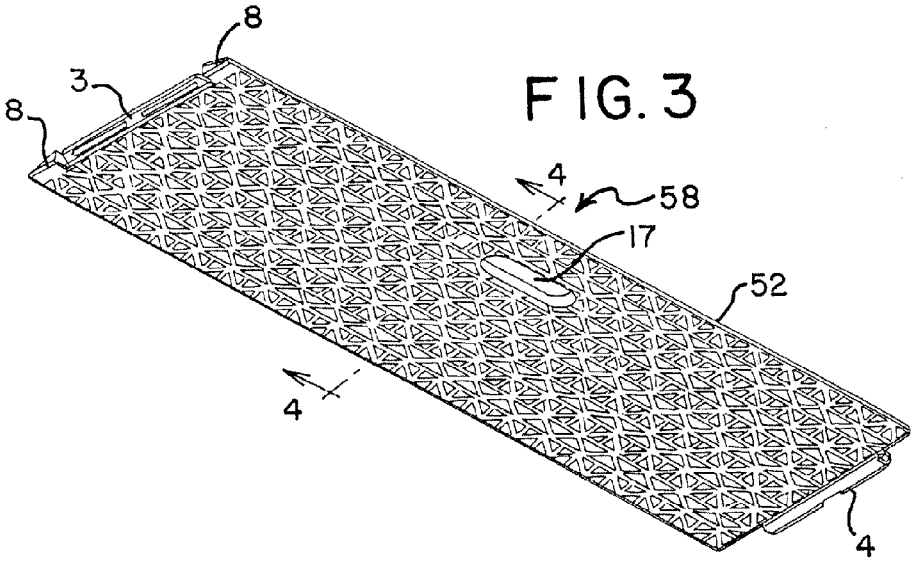
FIG. 3 is an isometric view of the bottom of the portable roadway warning device.

It should be understood that the term "longitudinal," as used herein means of or relating to the direction of a roadway 84 or traffic-flow, and also the between leading and trailing edges 50, 52 of a roadway warning device deployed across a roadway. The term "lateral," as used herein, means directed toward or running perpendicular to the roadway 84, and between opposite sides 54, 56 of the roadway warning device 1. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" may refer to any sequence of such roadway warning devices, and is not limited to the first and second roadway warning devices of a particular assembly unless otherwise specified. The term "rigid" means the ability to resist relative movement between components. The term "flexible" means the ability of components to move relative to each other with little applied force. The term "plurality" means two or more, or more than one. The phrases "roadway warning device" and "roadway warning assembly" refer to a device or assembly intended to provide feedback, or an alert, to a driver of a vehicle 60 driving over the device or assembly, whether by tactile, visual, auditory or other feedback and/or combinations thereof, and includes without limitation rumble strips, speed bumps, speed humps, tire spiking devices, etc., and combinations thereof. An "assembly" may include a single "device," or a plurality thereof.

Referring to FIGS. 1-5, embodiments of a system, assembly, method and apparatus for a roadway warning device 58, configured as a rumble strip in one embodiment, are shown. The portable roadway warning assembly 1 includes a plurality of roadway warning devices 58. Each roadway warning device 58 includes a core 2 made of a polymeric material 62 and a plurality of weights 64, a first connector, configured as an end loop 3 in one embodiment, a second connector, configured as an end hook 4 in one embodiment, and a housing 66. The housing 66 covers the core and includes an upper tread member 5, configured as a polymeric top and defining a vehicle interface surface in one embodiment, and a lower base member 6, configured as a polymeric bottom and defining a roadway engaging surface in one embodiment. It should be understood that the housing may cover only the bottom or the top of the core, or both. In one embodiment, each roadway warning device has a substantially flat top and bottom with a groove pattern over the surface to keep water from pooling under or on the top surface of the rumble strip. The upper surface may alternatively be curved, e.g., convex, or otherwise configured. The housing 66 includes beveled leading and trailing edge portions 16 extending longitudinally from the leading and trailing edges 50, 52. In one preferred embodiment, the polymeric material may be made of suitably abrasion resistant, high strength, and weather resistant material such as polyurethane, although other suitable materials could be used such as rubber, vinyl, neoprene, and etc.

The polymeric material 62 and plurality of weights 64 may be mixed together and molded into a shape defining the core 2, which allows the core 2 to fit on the interior of the housing 66. The core 2 or interior portion is made as large as possible to maximize its weight. The core 2 may be formed from a mixture of a flexible polymeric material such as urethane and a multiplicity of weights, which have a greater density than the polymeric material. In one embodiment, the weights are made of metal pieces such as metal shot or metal spheres of a diameter between 0.02 inch and 0.04 inch, preferably 0.03 inch steel shot, or as large as 0.078 inch shot. In some embodiments, the metal pieces may be very small and fine, for example configured as nanoparticles or metal powder. For example, the metal pieces may be fine pieces of iron called Iron nanoparticles (General size: 10 to 150 nm). Alternatively, the metal pieces may be Iron powder: General Size: 20-200 micrometers.

The metal pieces may have a maximum height dimension, e.g., diameter, equal to the thickness or height of the core, or even the housing. It should be understood that other materials and shapes could be used. For instance, the weights may be made from cast iron, lead or other suitably dense materials. Alternate shapes could also be chosen, for instance, round cylinders or disks, flat washers, square or rectangular shapes, as is appropriate for a particular design. In one embodiment, the maximum longitudinal or lengthwise dimension of the weight, whether a diameter or length, is equal to or less than a ½ of the distance D between the leading and tailing edges 50, 52, such that the device may flex or hinge about the junction(s) between the weights. In other embodiments, the weight has a maximum lengthwise dimension of ¼ D, ⅛ D or 1/16 D. A mixture, or slurry, of polymeric material 62 and weights 64 is poured into a mold form, and can be poured and directly in molded inside the housing 66 of the roadway warning device 58. In other embodiments, the weights and polymeric material may be added separately, whether the weights are added first or last.

Referring to FIGS. 25-28, different embodiments of the core 302 may be configured to increase the stiffness of the core in the longitudinal direction, or parallel to the direction of traffic on the roadway, while maintaining flexibility of the strip along a lateral extent thereof. The additional stiffness in the longitudinal direction may help minimize any oscillation from propagating through the warning device 58 along the direction of travel and thereby help maintain the warning device 58 flat on the road when the vehicle's rear tires passes over it. As such, the risk of creep in the direction of traffic is thereby minimized.

Figure 25:
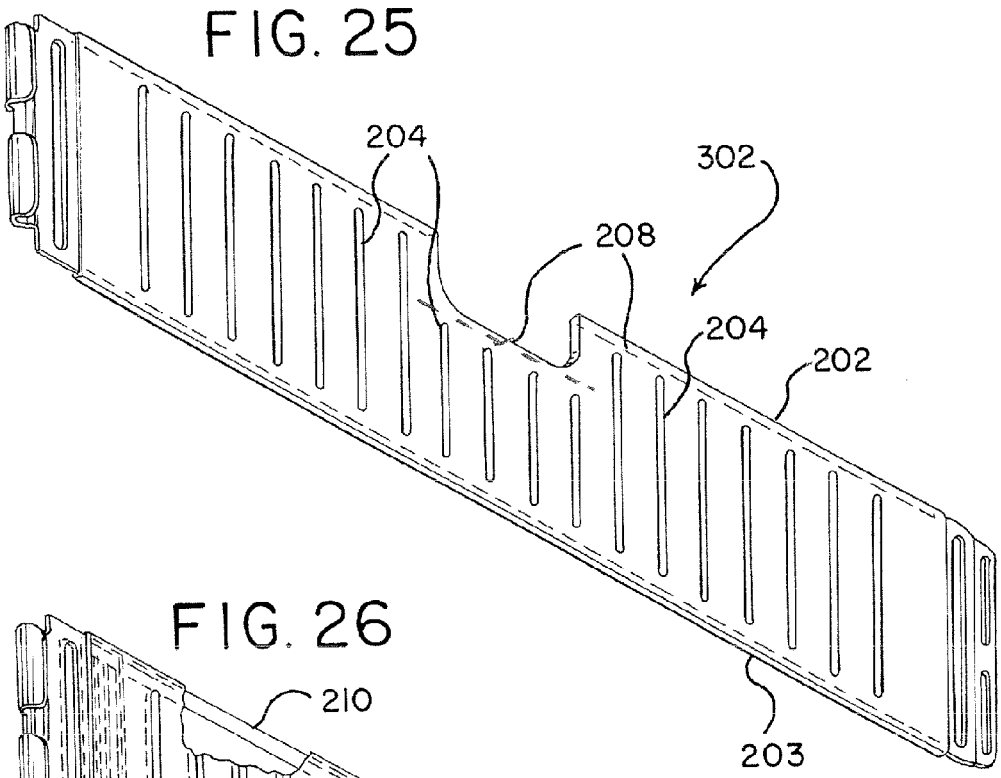
FIG. 25 is a perspective view of another embodiment of a core.
Figure 26:
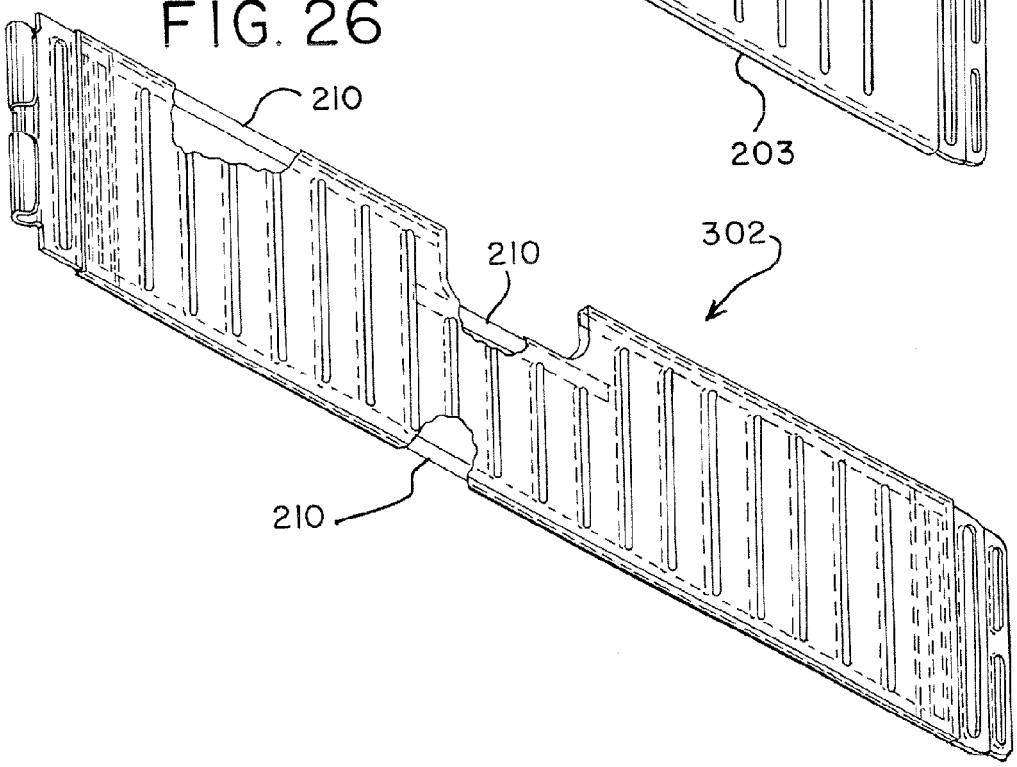
FIG. 26 is a perspective view of another embodiment of a core with partial cut-away portions.

In one embodiment, shown in FIGS. 25 and 26, the core 302, which is made as a single piece, is made of a harder durometer material, for example and without limitation Shore D55 or greater, mixed with a plurality of weights 64. The core 302 is formed with slots 204 running in the longitudinal direction from near one edge 202 to an opposite edge 203. In one embodiment, the end of the slot 204 is about ¾ inches from the edges 202, 203. In one embodiment, the slots 204 are about ⅛ inch to about ½ inch in width, and may be about ¼ inch in width. A plurality of pieces of wire 208 (FIG. 25) or fiberglass tape 210 (FIG. 26) are in-molded adjacent the edges 202, 203, or applied to the surface of the core along the edges and across the bridges of material between the ends of the slots and edges. The wire or tape maintains lateral connectivity of the core and prevents the core 302 from breaking apart during handling. After the housing 66 is formed around the core 302, whether by overmolding or by applying upper and lower tread members, the thin cross sectional portions between the ends of the slots 204 and the edges 202, 203 will flex or crack to allow the warning device 58 to be very flexible along the width thereof, with the harder material providing additional stiffness in the longitudinal direction.

Figure 28:
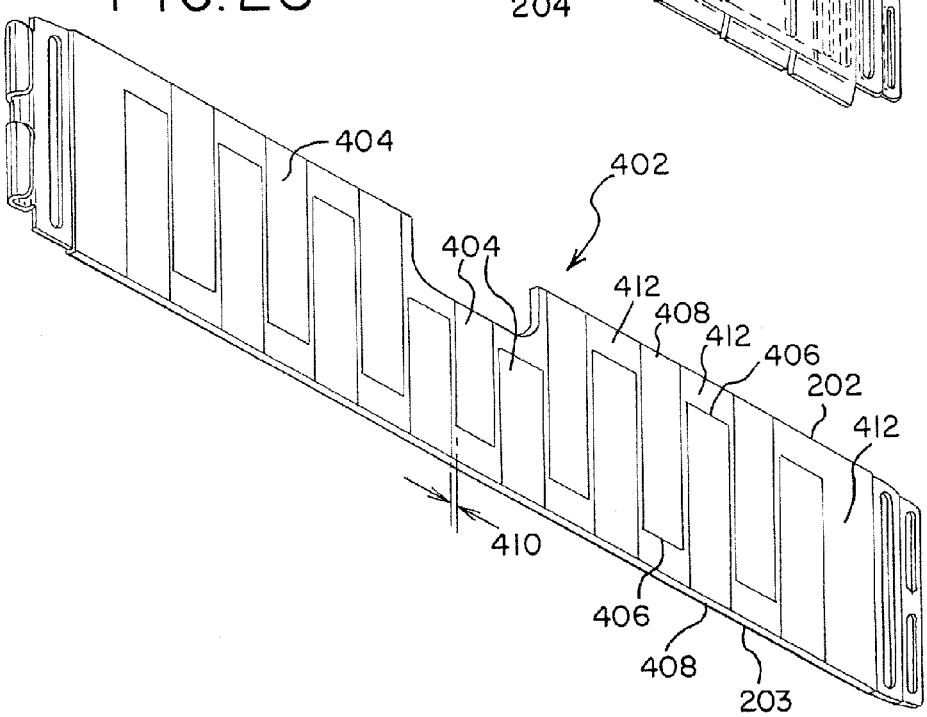
FIG. 28 is a perspective view of another embodiment of a core.

In another embodiment, shown in FIG. 28, a core 402 is formed from two different types of polymeric material, each mixed with weights 64. A first material is used to form a plurality of segments 404 sequentially staggered in the longitudinal direction. Each segment 404 has an end 406 spaced from one of the edges 202, 203 of the core, with an opposite end 408 abutting the other edge. The segments are made of a harder material, for example having a durometer of Shore D55 or higher and mixed with weights. The segments 404 are spaced apart with gaps 410 therebetweeen, for example a ¼ inch to ½ inch spacing. A lower durometer material, or filler 412, mixed with weights, fills the gaps and the spacing between the edge 202, 203 of the core and the ends 406 of the staggered segments, such that the filler 412, or lower durometer material, extends continuously in the lateral direction and connects the segments 404 of harder material together to form a single core structure. The filler 412 may be made of a material having a low durometer of Shore A70 or less. In this way, the core 402 is configured with a plurality of laterally spaced segments made of a first polymeric material joined by a filler made of a second polymeric material, wherein the first polymeric material is stiffer than the second polymeric material.

Figure 4:
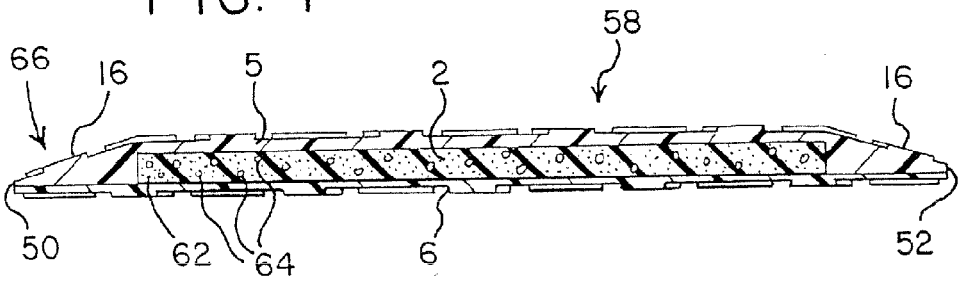
FIG. 4 is a cross-section of the portable roadway warning device taken along line 4-4 of FIG. 3.
Figure 27:
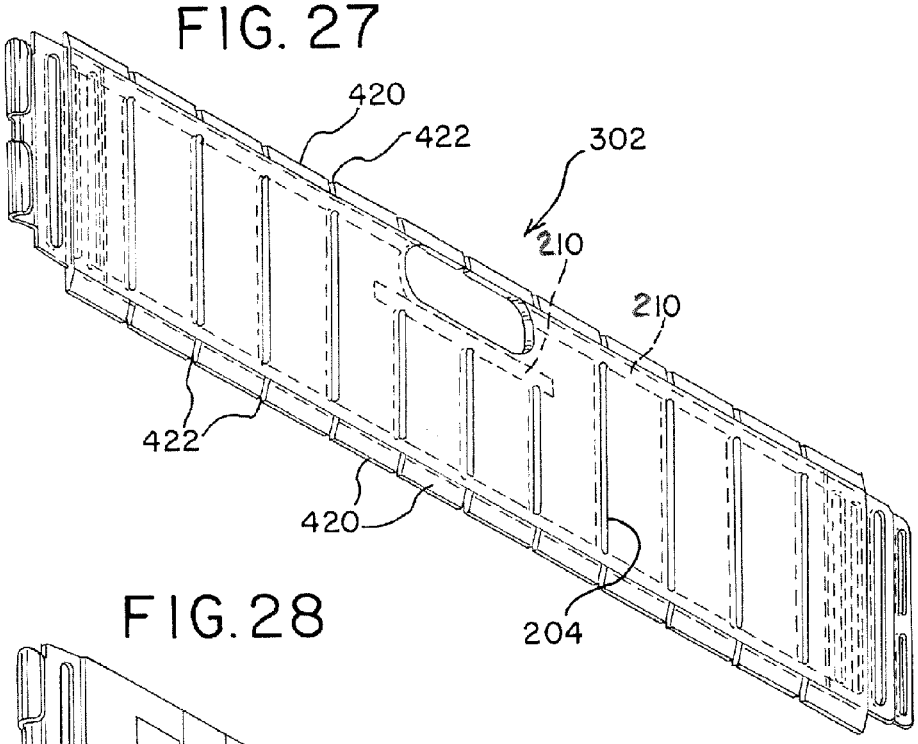
FIG. 27 is a perspective view of another embodiment of a core.

As shown in FIG. 4, sloped edge portions 16 of the warning device may not include a portion of the core, or stiffer material. This may permit the edge portions 16 to oscillate when a vehicle rolls over the slopped approach and retreating edge. Accordingly, as shown in FIG. 27, the core 102, 302, 402 may include additional wedge sections 420 formed along the approach and retreating edge of the warning device so as to prevent the edge portions 16 from undulating. The wedge sections 420 may be covered or overmolded with the housing. Slits 422 may be formed between the wedge sections 420 to allow the warning device to be able to flex along the lateral width thereof.

The housing may also be made of various materials that reduce the vertical rebound thereof, as determined by the ASTM specification D 2632, measured on a scale from 1 to 100. In one embodiment, the material preferably has an ASTM D 2632 rebound of 25 or less, while in another embodiment, the material more preferably has a rebound of 10 or less, while in another embodiment, the material preferably has a rebound of about 5.

The first connector, or end loop 3, is preferably made of a hard material, such as galvanized steel or other high strength material that is weather resistant, such as stainless steel, aluminum, or carbon fiber composite. The end loop 3 includes one or more end slots 11, which are shaped and dimensioned to connect to the second connector members, or hooks 13. Preferably, each of the first and second connectors includes a plurality of loops and hooks respectively, shown for example as two of each. Additional slots or holes 12, 14 are provided to allow the polymeric material to penetrate the first and second connectors and bond the connectors securely to the housing. Alternatively, an anchor element may extend through the slots or holes 12, 14 to hold the connectors in place.

Figure 11A:
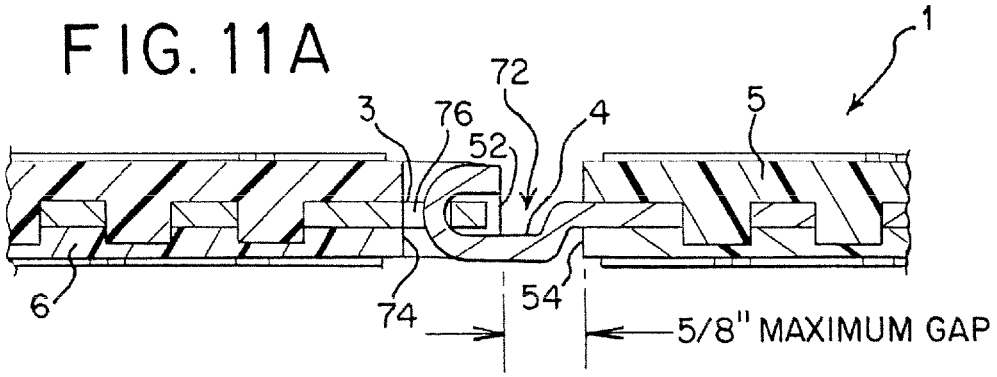
FIGS. 11A and B are cross-sectional views of the connection between adjacent portable roadway warning devices with respective maximum and minimum gaps formed between the warning devices.
Figure 11B:
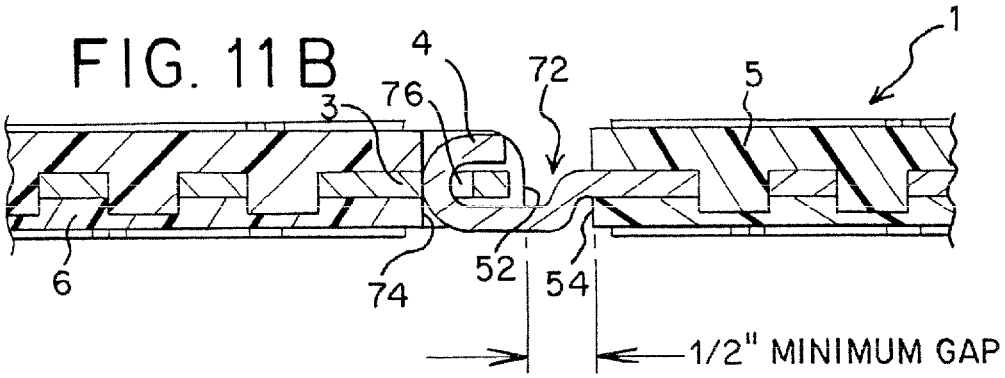

The second connector, or end hook 4, also is preferably made of a hard material, such as galvanized steel or other high strength material that is weather resistant, such as stainless steel, aluminum, or carbon fiber composite. It contains one or more hooks 13 that connect to the loops 11. As shown in FIGS. 6 and 11A-B, the hooks have a cross-sectional C-shape, and form a channel opening toward the side 54 of the roadway warning device.

The configuration of hooks 4 and loops 3 provide a simple and quick way to connect adjacent ones of the roadway warning devices 58 as shown in FIGS. 6 and 9*a-e*. The connection between the first and second connectors provides an extremely secure connection between the adjacent roadway warning devices, i.e., a locked configuration, and prevents adjacent roadway warning devices, when connected in a planar connection (FIG. 9*e*) from detaching from each other in all directions including in the Z-axis (Vertical) direction.

In operation, as shown in FIGS. 9*a-e*, adjacent roadway warning devices are positioned in a non-planar relationship (FIG. 9*a*), or disengaged configuration/position, shown as an orthogonal relationship in one embodiment, such that a bar 70 defining the loop may be positioned in a recess or mouth 72 of the hook 4. The adjacent roadway warning devices are then rotated relative to each other. For example, the roadway warning device having the loop positioned in the mouth is rotated away from the adjacent roadway warning device such that the loop passes over the hook and becomes engaged therewith. When rotated to a planar position relative to each other, the adjacent roadway warning devices are in a locked configuration/position. In this position, the sides 52, 54 of the housing are spaced apart. Referring to FIGS. 11A and B, due to the size of the loop opening 76, the hook 4 may move from the front of the opening 76, where the hook engages the bar 70, to the rear of the opening where the hook abuts an inner surface 74 of the housing. In either case, a gap is maintained between the sides of the adjacent devices.

Figure 9A:
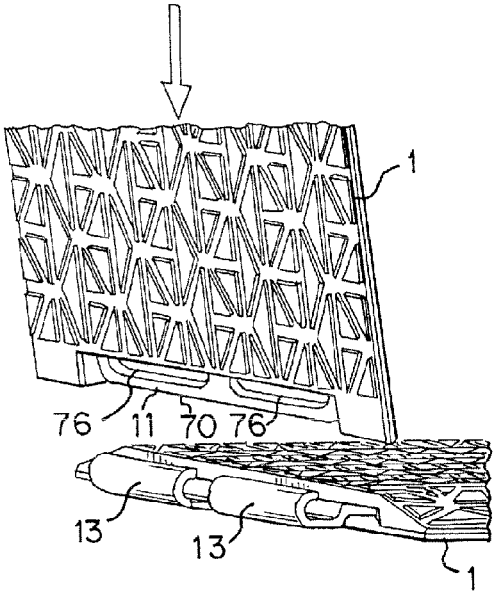
FIGS. 9*a-e* show the attachment sequence for connecting adjacent rumble strips together.
Figure 9B:
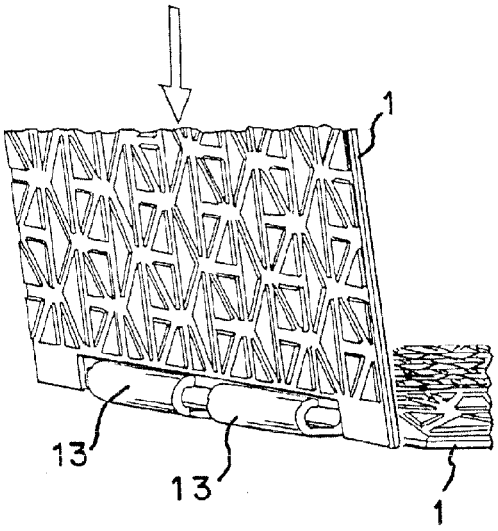
Figure 9C:
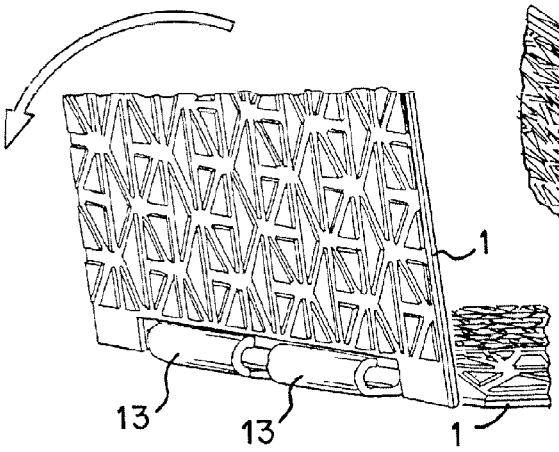
Figure 9D:
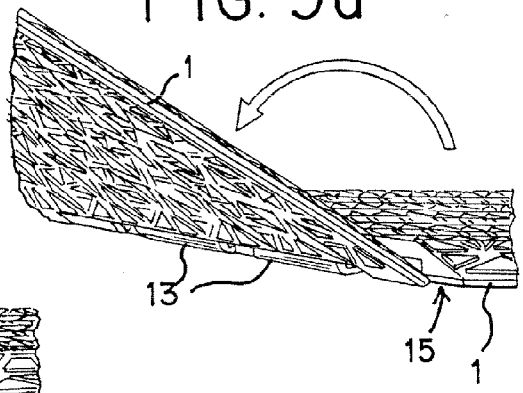
Figure 9E:
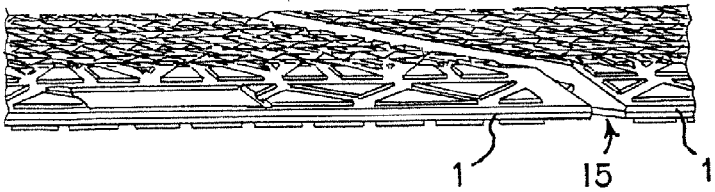
Figure 10:
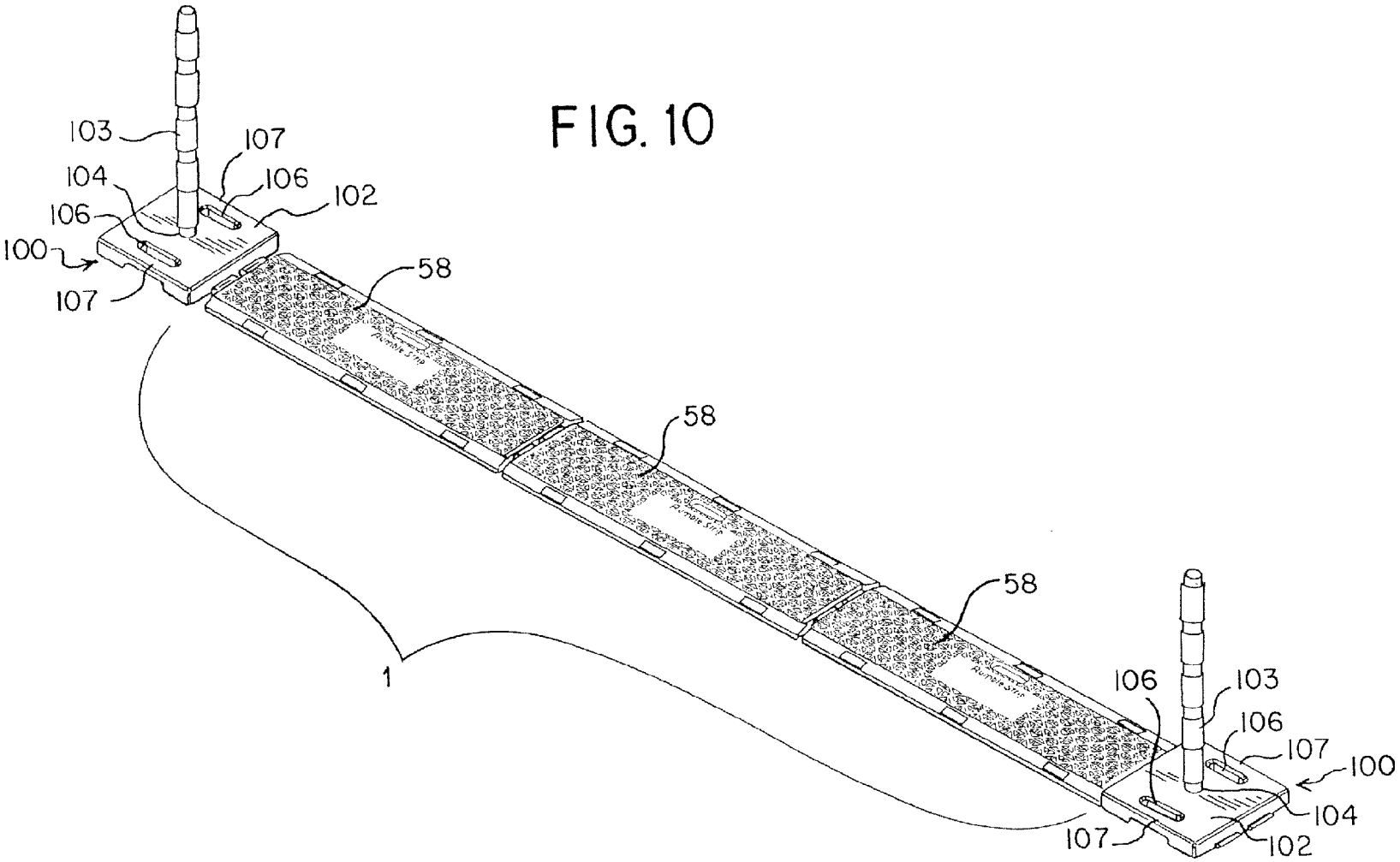
FIG. 10 is a perspective view of another embodiment of a portable roadway warning device assembly.

Referring again to FIGS. 9*a-e*, adjacent roadway warning devices are shown in various stages of assembly. In FIG. 9*a*, a road worker places a roadway warning device 58 at an approximate 90 degree orientation to a second roadway warning device 58 that has already been placed on the roadway. The road worker then aligns the bar 70 of the first rumble strip with the mouth 72 of the second rumble strip. The first roadway warning device is then lowered into place, so that the slots 11 and hooks 13 align, as is shown in FIG. 9*b*. In FIG. 9*c*, the first roadway warning device 58 is rotated away from the second warning device, so that the hooks 13 engage with the slots 11. The first roadway warning device 58 is rotated further in FIG. 9*d* and in FIG. 9*e*, it is shown rotated until it lies flat against the roadway. In this orientation, hooks 13 are fully engaged in slots 11. The hook and loop are firmly imbedded in the rumble strip so that they cannot be pulled out. The hook is imbedded such that its opening is placed in the top position of a horizontally lying roadway warning device. This allows the loop of an adjacent roadway warning device, in the vertical position, to be placed inside the mouth of the hook. The hook and loop are thus attached together as the vertical rumble strip is lowered and rotated to the horizontal position. The short-axis sides of the rumble strip are extended to the side of the loop. However, a gap between the rumble strips is maintained at all times to provide an open space that allows the loop of one rumble strip to connect into the hook of the other. During rain showers or other water events, the gap also prevents water from pooling up on one side of the rumble strip when the rumble strip is placed on a roadway that is inclined along a longitudinal direction (up or down).

Figure 24:
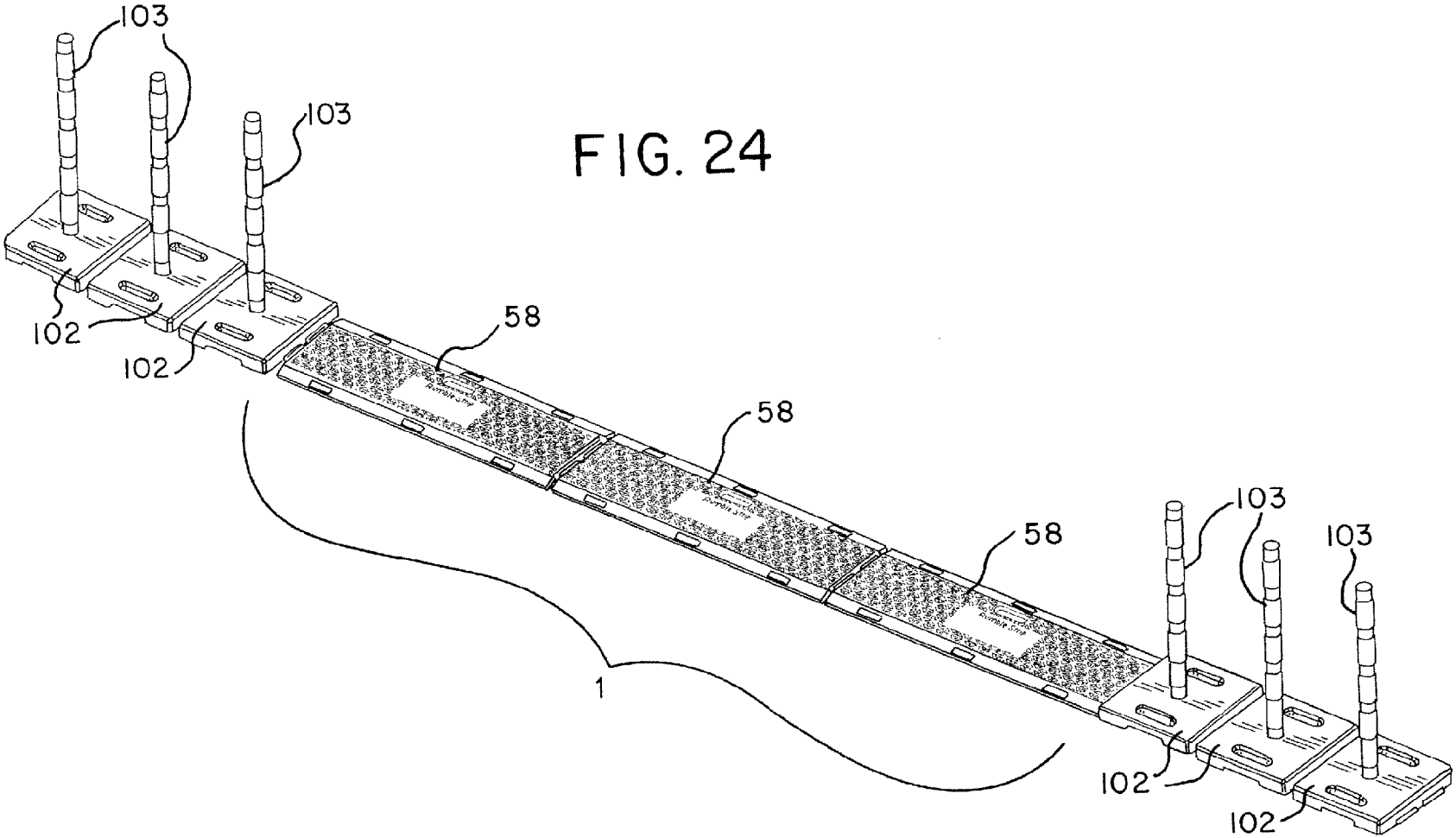
FIG. 24 is a perspective view of another embodiment of a portable roadway warning device assembly.

Referring to FIGS. 10, 13-17 and 24, an auxiliary warning device 100 may be connected to a roadway warning device or assembly. Although shown as connected to the roadway warning devices 58 on the opposite ends of an assembly 1 thereof (FIGS. 10 and 13), it should be understood that the device 100 may also be connected between two roadway warning devices, for example in the middle of an assembly to show a division of roadway lanes. Alternatively, as shown in FIG. 24, a plurality of pads, with posts alone, or also with signs, may be connected to each other.

The auxiliary warning device 100 includes a base, configured as a pad 102, having a mounting hole 104 shaped to receive a post 103. The base may also include a pair of elongated openings 106 in a top and bottom side of the pad forming handles 107 for gripping by a user. The base 102 may be made of a polymeric material, similar to the housing of the roadway warning device and may include a core having weights similar to the roadway warning device. The base may alternatively be made of crumb rubber or other similar materials, or non-flexible materials such as metal, e.g., steel, wood, and/or combinations thereof. The base may be square, or have other polygonal shapes, such as a rectangular shape that allows for more than one post to be attached when configured with a plurality of holes 104. Opposite ends of the base are configured with connectors having hooks or loops that are positioned to be connected to the connectors 3, 4.

The post 103 may be made of polyurethane, linear low density polyethylene, or other similar vertical delineator post materials. Alternate materials may be metal, e.g., steel, or wood, which may be configured with a breakaway interface between the post and base. The post 103 can include a reflective material 120, configured in one embodiment as spaced apart stripes of reflective tape to provide further warning indicia to approaching vehicles. In one embodiment, the post can be a SAFE-HIT post or Dura-Post® post, as manufactured and sold by Trinity Highway Products, Dallas Tex. Such posts are capable of being impacted by a vehicle, and may rebound after an impact.

Figure 13:
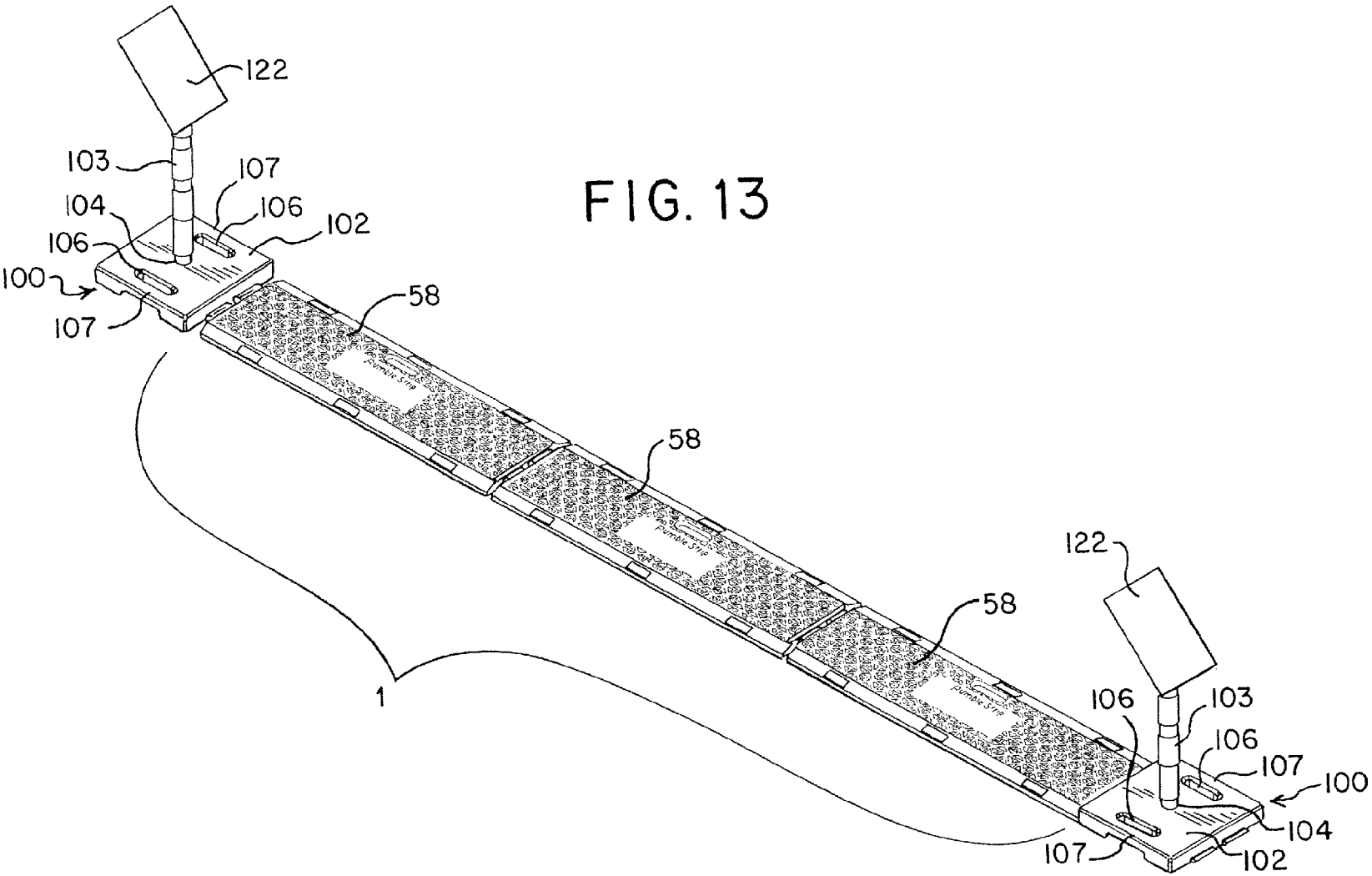
FIG. 13 is a perspective view of another embodiment of a portable roadway warning device assembly.
Figure 14:
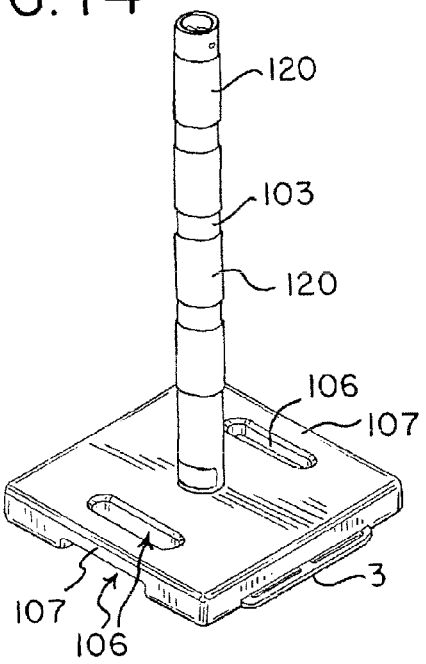
FIG. 14 is a perspective view of a post and pad assembly.
Figure 15:
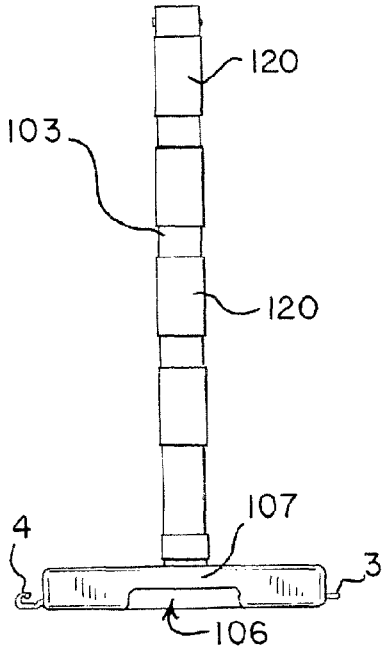
FIG. 15 is a front view of the post and pad assembly shown in FIG. 14.
Figure 16:
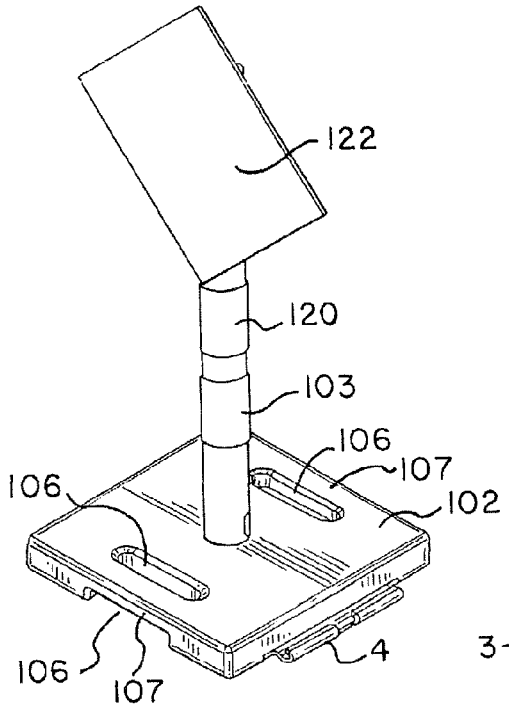
FIG. 16 is a perspective view of a post and pad assembly configured with a sign.
Figure 17:
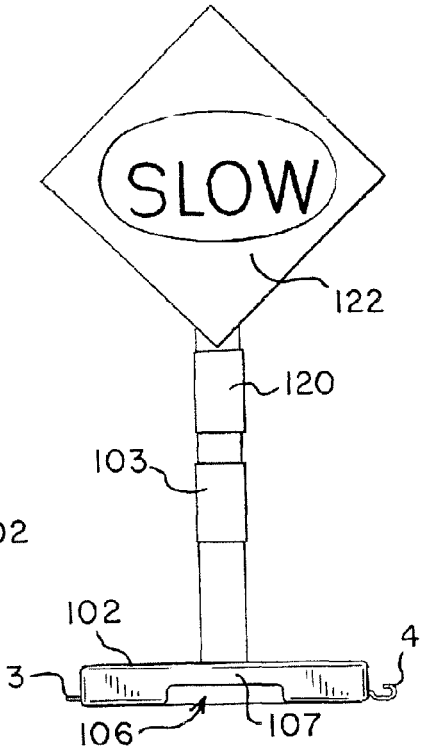
FIG. 17 is a front view of the post and pad assembly shown in FIG. 16.

Referring to FIGS. 13, 16, and 17, a sign 122 may be secured to the top of the post 103. The face of the sign may be configured with various instructional indicia 107, such as phrases or alphanumeric characters. Various examples of indicia include "Rumble Strip", "Slow", "Speed bump", "Work zone", or a required speed limit. The sign 122 may also have arrows showing the preferred direction of travel. The sign may be made of plastic or thin aluminum, and may have any shape depending on local and state ordinances, including circular, diamond, square, rectangular, octagonal, etc.

Figure 18:
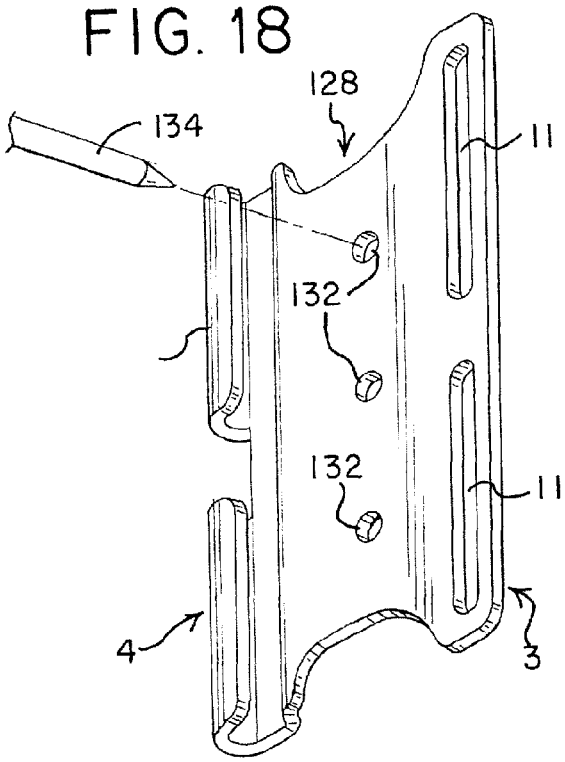
FIG. 18 is a perspective view of one embodiment of a two-way connector.

Referring to FIG. 18, a two-way connector 128 is shown configured with an end loop 3 having a pair of slots 11 and an end hook 4 having a pair of hooks 13. A connector plate 130 is configured with a plurality of holes 132. The connector 128 may be disposed between and connect to either end of a roadway warning device 58. The connector may also serve as an anchor, with spikes 134 being inserted through the holes 132, for example with the assembly is located across or along a steep incline. The anchor spikes may be nails installed with a hammer, or other types of chemical and/or mechanical anchors may be used. In either application, holes may be drilled into the roadway at the appropriate locations for the anchors. Chemical anchors are installed by placing epoxy or other polymer grout into the hole 132, followed by a metal anchor 134. Mechanical anchors may be placed into the hole and then tightened, which expands an end of the anchor and holds it in place.

Figure 19:
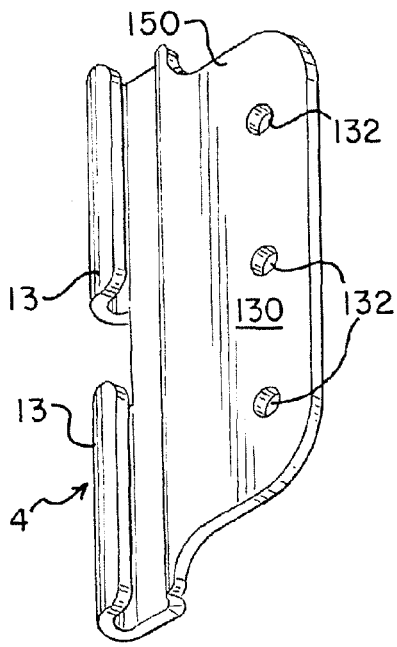
FIG. 19 is a perspective view of one embodiment of an anchor connector.
Figure 20:
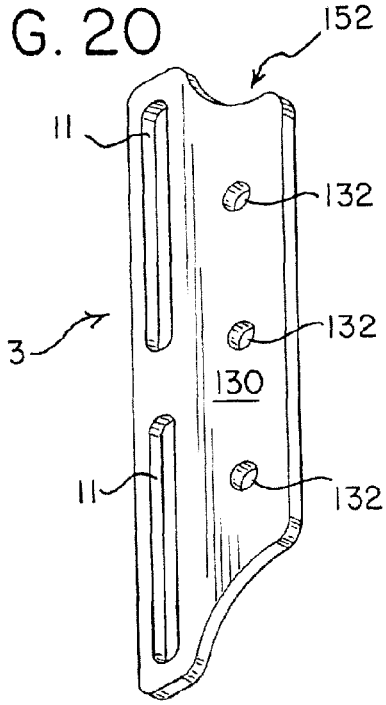
FIG. 20 is a perspective view of one embodiment of an anchor connector.

Referring to FIGS. 19 and 20, anchor connectors 150, 152 may alternative be configured with a plate 130 and one or other of an end loop 3 (FIG. 20) or end hook 4 (FIG. 19). The connectors may be similarly connected to the end of a roadway warning device or assembly and then anchored to the ground with one or more anchors 134. Depending on the configuration of the end of the roadway warning device, a connector is selected with a mating end hook or end loop.

Figure 21:
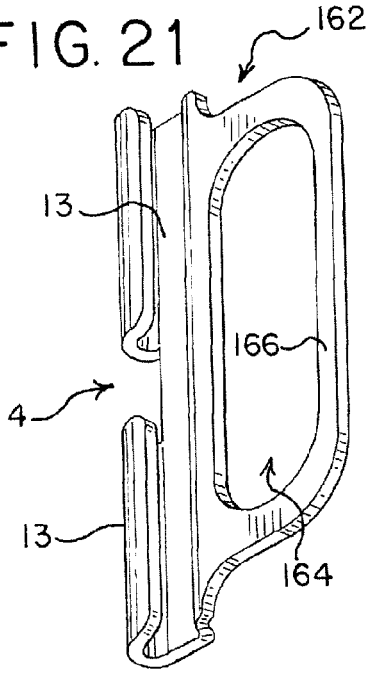
FIG. 21 is a perspective view of one embodiment of a handle.
Figure 22:
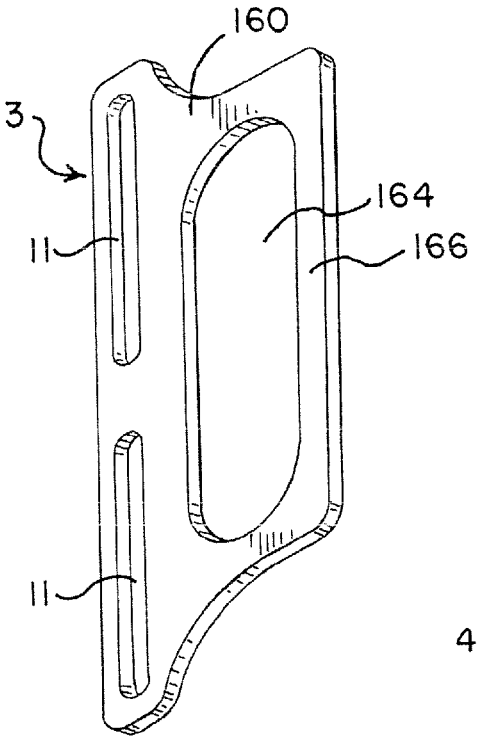
FIG. 22 is a perspective view of one embodiment of a handle.

Referring to FIGS. 21 and 22, alternative handle embodiments 160, 162 may be configured with an end loop 3 (FIG. 22) or end hook 4 (FIG. 21), with the slots 11 or hooks 13 configured to mate with corresponding hooks and slots on an adjacent roadway warning device. In either embodiment, the handle is configured with an opening 164 defining a loop 166 or handle that may be gripped by a user. The user may then pull or otherwise manipulate the handle 166 and connected roadway warning device or assembly, thereby allowing the user to easily drag the device/assembly with one hand if necessary.

Figure 23:
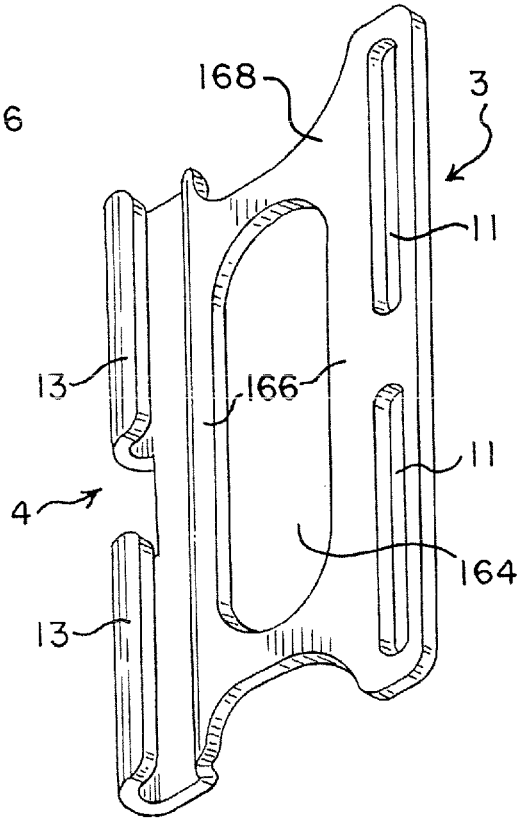
FIG. 23 is a perspective view of one embodiment of a two-way connector.

Referring to FIG. 23, a handle embodiment 168 is configured with an opposite end loop and hook 3, 4, with a central, elongated opening 164 defining opposite loops or handles 166. In this embodiment, the handle 166 may be connected to either end of the roadway warning device and grasped such that the user may manipulate the device or assembly, e.g., by dragging the device or assembly.

Referring to FIGS. 1 and 4, the roadway warning device 58 may be manufactured in several ways. As described above, the core may be formed with slots therein. Wire or tape maybe provided to make the core more robust in handling. Alternatively, the core may be made with segments of a first polymeric material joined by a filler material of a second polymeric material, both including a mix of a plurality of weights.

In addition, in a first method, the housing 66 includes an upper tread member 5 separate from the lower base member 6. The core 2 is positioned or sandwiched between the members 5, 6, with the first and second connectors 3, 4 also sandwiched between the members 5, 6. Either or both of the members 5, 6 may include one or ribs 80 or protuberances, i.e., anchor members, that are received in the openings 12, 14, which may be formed as recesses. The members 5, 6 and first and second connectors 3, 4 may be joined to each other, and to the core 2, using a bonding agent such as glue or epoxy.

In an alternative method, a polymeric material is poured or injection molded around the core 2 and first and second connectors 3, 4. In this embodiment, the upper and lower members 5, 6 may be integrally formed as a single member, with the material penetrating the openings 12, 14. In either embodiment, the polymeric material of the housing 66 is preferably soft enough to grip and contour to the road, preferably between 70 and 90 Shore A Durometer. The preferred minimum thickness of the members 5 and 6 is from 1/16 to 1/8 inch, and 3/32 inch in one embodiment.

Figure 5:
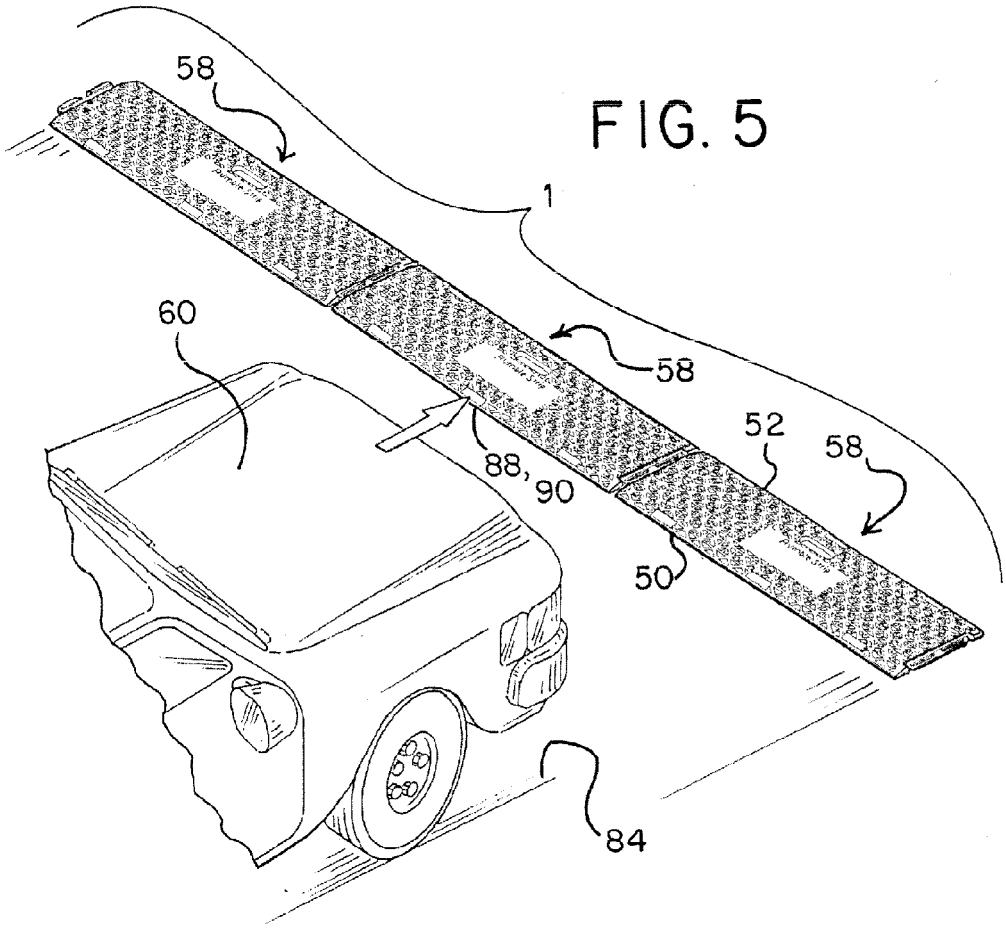
FIG. 5 is an isometric view of roadway warning device assembly including a plurality of portable roadway warning devices coupled together.

The roadway control assembly 1 is preferably of sufficient length to span across a roadway, e.g., a single highway lane 84, which is typically 11 feet (132 inches) wide. To minimize the amount of assembly and to keep the weight of each portable rumble strip to less than 45 lbs, the maximum length of each section is preferred to be approximately 44 inches and between 8 and 16 inches wide and more preferably approximately 13 inches wide. In such an embodiment, a minimum of three interconnected roadway warning devices 58 may be required to span a typical traffic lane as shown in FIG. 5.

The roadway warning device 58 has a feature 8 configured as a tab, shown in FIG. 6, which extends to the side of the loop end 3. The feature 8 does not completely fill in the gap 15 between the adjacent roadway warning devices 58, however, but rather maintains a spacing that allows water to easily pass between the roadway warning devices that are mounted on an inclined road. The gap 15 also allows adjacent roadway warning devices to be easily connected without interfering with each other as shown in FIG. 9*a* through FIG. 9*e*.

The top surface of the roadway warning device may be covered by a groove pattern 7 that prevents water from pooling on the surface of the rumble strip. The bottom surface of the roadway warning device may also be covered by a groove pattern 7 that keeps the roadway warning device 58 from sliding on top of pooled water. The groove can have a depth of 0.03 to 0.1 inches preferably 0.050 inches deep. In one embodiment, the groove pattern 18 may be molded to match and repeat the logo of a company making the roadway control device, or a customer purchasing and using the roadway control device, so long as the design provides a method for water to drain away from the bottom and top surface of the rumble strip. For example, item 19 is the logo of Trinity Highway Products, the Assignee of this application.

The leading and trailing edge portions 16 are beveled to minimize the horizontal/shear force applied to the roadway warning device 58 during a rollover event with a vehicle. The preferred angle of the bevel is between 10° and 18° and preferably approximately 16° with respect to the horizontal plane. Beveling both the leading and trailing long-axis edges of the rumble strip makes the product symmetrical and allows the user to place the rumble strips into position without regard to orientation.

A hand-hold through-slot 17 is provided along the center of the device in the housing near the edge of the roadway warning device 58 to define a grippable handle and allow the user to easily carry individual sections. The size of the slot can be of any suitable size, but preferably 5½ inches by 1½ inches, which would be large enough for an average sized gloved hand to fit. The hook and loop at the end of each rumble strip may also be used as a grippable hand hold to drag a chain of roadway warning devices onto or off of the road.

The portable roadway warning devices, when configured as a rumble strip, are designed preferably to have a thickness of approximately 0.82 inches thick which is similar to what has been reported by the FHWA. This thickness creates a noticeable audible and vibration warning without overly startling drivers or causing instability of the vehicles. The required thickness of the rumble strip limits the pressure that a rumble strip can apply to the road. This pressure, at least in part, maintains the position of the rumble strip when subjected to heavy roadway at highway speeds. The pressure that a rumble strip may apply to the road is based on its thickness and its density. A sufficiently flexible polymeric material by itself may not be made to a high enough density to allow the rumble strip to apply enough pressure to the road to keep the rumble strip from sliding. The required minimum density for the polymeric flexible material is about 0.08 $lb/in^3$. To increase the weight of the rumble strip, while maintaining flexibility, durability, and a smooth surface finish, the rumble strip may be made in two parts. The inside core 2 is made of a mixture of a flexible polymeric material and a plurality of weights, preferably metal pieces such as metal shot or metal spheres. This mixture is poured into a form that can be molded. In one embodiment, the core is in-molded in the housing. The housing is made of another flexible polymeric material that is weather resistant. The housing may be poured or injected around the core. If a lower durometer polymeric material is used, the rumble strips may also be rolled up for storage. Using a plurality of small weights allows the rumble strips to match the contour of the road in all directions, including the longitudinal and lateral directions.

Additional flat recesses 88 that are less wide than vehicle tires are equally spaced along each beveled edge. A reflective or illuminating material or member 90, including a reflective tape, may be applied to or mounted in the recesses, below the adjacent upper vehicle interface surface adjacent the recesses, to help increase the visibility of the roadway warning device. The flat spots are recessed and not too wide so that there will be minimal pressure from the vehicle tires against the tape, material, or device.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A portable roadway warning device comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface.

2. The portable roadway warning device of claim 1 wherein said housing comprises an upper tread member and a lower base member, wherein said core is sandwiched between said upper tread member and said lower base member.

3. The portable roadway warning device of claim 2 wherein said first and second connector members are sandwiched between said upper tread member and said lower base member.

4. The portable roadway warning device of claim 2 wherein said upper tread member and said lower base member are integrally formed.

5. The portable roadway warning device of claim 1 wherein said first connector member comprises a loop member and wherein said second connector member comprise a hook member.

6. The portable roadway warning device of claim 1 wherein said housing comprises a polymeric material and said first and second connector members comprise a non-polymeric material.

7. The portable roadway warning device of claim 6 wherein said first and second connector members are made of metal.

8. The portable roadway warning device of claim 1 wherein said upper vehicle interface surface comprises an embossed logo.

9. The portable roadway warning device of claim 1 wherein said plurality of weights comprise a plurality of metal shot.

10. The portable roadway warning device of claim 9 wherein said metal shot have diameters of greater than or equal to 0.02 inches and less than or equal to 0.078 inches.

11. A portable roadway warning device comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface, wherein said first and second connector members are spaced apart in a lateral direction and said leading and trailing edges are spaced apart in longitudinal direction, wherein said core comprises a plurality of laterally spaced slots extending in a longitudinal direction.

12. A portable roadway warning device comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface, wherein said first and second connector members are spaced apart in a lateral direction and said leading and trailing edges are spaced apart in longitudinal direction, wherein said core comprises a plurality of laterally spaced segments comprising a first polymeric material joined by a filler comprising a second polymeric material, wherein said first polymeric material is stiffer than said second polymeric material.

13. The portable roadway warning device of claim 12 wherein said segments are sequentially staggered in said longitudinal direction.

14. A portable roadway warning assembly comprising:

a plurality of roadway warning devices each comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface;

wherein said first connector member of one of said plurality of roadway warning devices is connected to said second connector member of an adjacent one of said plurality of roadway warning devices.

15. The portable roadway warning assembly of claim 14 wherein said housing comprises an upper tread member and a lower base member, wherein said core is sandwiched between said upper tread member and said lower base member.

16. The portable roadway warning assembly of claim 15 wherein said first and second connector members are sandwiched between said upper tread member and said lower base member.

17. The portable roadway warning assembly of claim 14 wherein said first connector member comprises a loop member and wherein said second connector member comprise a hook member.

18. The portable roadway warning assembly of claim 17 wherein said first side of said one of said plurality of roadway warning devices is spaced apart from said second side of said adjacent one of said plurality of roadway warning devices.

19. The portable roadway warning assembly of claim 17 wherein said one of said plurality of roadway warning devices and said adjacent one of said plurality of roadway warning devices are rotatable relative to each other from a disengaged configuration, wherein said one of said plurality of roadway warning devices and said adjacent one of said plurality of roadway warning devices are in a non-planar relationship and said loop member is disengaged from said hook member, to a locked configuration, wherein said one of said plurality of roadway warning devices and said adjacent one of said plurality of roadway warning devices are in a planar relationship and said loop member is engaged with said hook member.

20. The portable roadway warning assembly of claim 14 wherein said housing comprises a polymeric material and said first and second connector members comprise a non-polymeric material.

21. The portable roadway warning assembly of claim 14 wherein said upper vehicle interface surface comprises an embossed logo.

22. The portable roadway warning assembly of claim 14 wherein said plurality of weights comprise a plurality of metal shot.

23. The portable roadway warning assembly of claim 22 wherein said metal shot have diameters of greater than or equal to 0.02 inches and less than or equal to 0.078 inches.

24. The portable roadway warning assembly of claim 14 further comprising an anchor connected to one of said first and second connector members.

25. The portable roadway warning assembly of claim 14 further comprising a handle connected to one of said first and second connector members.

26. A portable roadway warning assembly comprising:

a plurality of roadway warning devices each comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface, wherein said first connector member of one of said plurality of roadway warning devices is connected to said second connector member of an adjacent one of said plurality of roadway warning devices, and an auxiliary warning device comprising a base having first and second connector members extending from opposite sides thereof and configured to mate with said first and second connector members of said roadway warning device, and a post extending upwardly from said base.

27. The portable roadway warning assembly of claim 26 further comprising a sign connected to said post.

28. A portable roadway warning assembly comprising:

a plurality of roadway warning devices each comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface, wherein said first and second connector members are spaced apart in a lateral direction and said leading and trailing edges are spaced apart in longitudinal direction, wherein said core comprises a plurality of laterally spaced slots extending in a longitudinal direction;

wherein said first connector member of one of said plurality of roadway warning devices is connected to said second connector member of an adjacent one of said plurality of roadway warning devices.

29. A portable roadway warning assembly comprising:

a plurality of roadway warning devices each comprising:

a core comprising a plurality of weights embedded in a polymeric material, wherein said weights have a greater density than said polymeric material;

a housing comprising opposite first and second side surfaces, a leading edge, a trailing edge longitudinally spaced from said leading edge, and an upper vehicle interface surface, said housing covering said core, wherein said leading and trailing edges define a distance D therebetween, wherein each of said weights has a maximum dimension in a longitudinal direction less than or equal to ½ D; and a first connector member extending outwardly from said first side surface, and a second connector member extending outwardly from said second side surface, wherein said first and second connector members are spaced apart in a lateral direction and said leading and trailing edges are spaced apart in longitudinal direction, wherein said core comprises a plurality of laterally spaced segments comprising a first polymeric material joined by a filler comprising a second polymeric material, wherein said first polymeric material is stiffer than said second polymeric material;

wherein said first connector member of one of said plurality of roadway warning devices is connected to said second connector member of an adjacent one of said plurality of roadway warning devices.

30. The portable roadway warning assembly of claim 29 wherein said segments are sequentially staggered in said longitudinal direction.

* * * * *